United States Patent [19]

Ressel

[11] Patent Number: 4,937,543

[45] Date of Patent: Jun. 26, 1990

[54] RELAY ASSEMBLY HAVING PLUG CONNECTIONS

[75] Inventor: Bernd Ressel, Berlin, Fed. Rep. of Germany

[73] Assignee: Siemens Aktiengesellschaft, Berlin and Munich, Fed. Rep. of Germany

[21] Appl. No.: 291,261

[22] Filed: Dec. 28, 1988

[30] Foreign Application Priority Data

Jan. 28, 1988 [DE] Fed. Rep. of Germany ..... 3802564

[51] Int. Cl.[5] ..... H01H 67/02

[52] U.S. Cl. ..... 335/128; 335/202; 335/133

[58] Field of Search ..... 335/128, 78–85, 335/202, 133

[56] References Cited

U.S. PATENT DOCUMENTS 4,346,359 8/1982 Pirner et al. ..... 335/202
4,745,382 5/1988 Dittman ..... 335/128

FOREIGN PATENT DOCUMENTS 7909986 9/1980 Fed. Rep. of Germany .
3428595 2/1986 Fed. Rep. of Germany .

*Primary Examiner*—Leo P. Picard
*Assistant Examiner*—Lincoln Donovan
*Attorney, Agent, or Firm*—Hill, Van Santen, Steadman & Simpson

[57] ABSTRACT

A relay assembly has a header with a relay chamber at the upper side and at least two plug receptacles or shafts at the underside thereof. A relay system including a coil member is in the relay chamber and connector elements in the form of flat plug elements are conducted through to the underside in the plug receptacles. A stationary contact element is connected to a plug in the first plug receptacle and a moveable contact element is connected to a plug element in the second plug receptacle via a current conducting rail. At least one current conducting rail is connected to plug elements in both plug receptacles. The plug shafts are suitable for accepting multiple pole plug connectors which makes it possible to connect a control for the relay and a load circuit via separately pluggable multiple pole plug connectors.

12 Claims, 3 Drawing Sheets

RELAY ASSEMBLY HAVING PLUG CONNECTIONS

BACKGROUND OF THE INVENTION

1. Field of the Invention

The present invention is directed generally to a relay assembly having a header or pedestal. More particularly, the header or pedestal has a flat bottom or floor part with ribs applied at the upperside thereof and guide channels proceeding through to the underside. The relay assembly also has a coil member which carries a winding, a core, a yoke and an armature. The coil member rests on the floor part of the header and includes two flanges with downwardly extending projections applied to the flanges. At least one of the flanges has a receptacle for at least one stationary cooperating contact element. The coil member also has plug elements conducted through to the underside of the floor part in the guide channels in the header, the plug elements being for the cooperating contact element, for connections to the winding and for at least one moveable contact element coupled to the armature.

2. Description of the Related Art

A relay having a plug header is disclosed, for example, in German published application No. 34 28 595. The header of the relay occupies only the area under the magnet system in a traditional fashion and the connector elements for excitation of the relay and for the contact elements all emerge from the header in one region under the magnet system. The disclosed relay includes flat plugs in the plug header either plugged into a correspondingly adapted plug-in socket which has individual wiring for the terminals or the individual flat plugs of the relay are connected with individual lines via cable or wire sockets. Such relays are not designed for connection to multi-lead cables with multi-pole plug-type connectors.

In the application of relays of the above type in various fields, such as motor vehicle technology, the need frequently arises for the relay to be easily interchangeable. Such relays, operating as switch assemblies, are connected with a control arranged remote therefrom and with one or more users, such as a pump motor or a lamp group also arranged at a different location. This has hitherto been possible only by individually connecting the flat plugs which emerge from the relay header in a tightly interleaved arrangement with cable sockets. When, for example, one wishes to replace the user, which may, for example, be a motor, then the motor posts have to be sought out for the various terminals and the appertaining cable sockets pulled off. The reverse operation is then required for connection of the new motor.

SUMMARY OF THE INVENTION

An object of the invention is to provide individual connectable plug connections for a relay assembly with, on the one hand, a control means and, on the other hand, the user means using standard multi-pole plug connectors. Another object of the invention is to require optimally few and optimally simple connector elements between the relay system and the respective plug elements for the plug connections.

These and other objects are inventively achieved by a header which forms a relay chamber toward the upper side of a floor part the floor part being provided with side walls proceeding on all sides. The header also forms at least two plug receptacles or shafts toward the underside of the floor part for accepting two respective multi-pole plug connectors. In addition, a cooperating contact element of the relay has a downwardly applied plug element connected in a first of the two plug receptacles. Furthermore, at least one current conducting rail that is arranged at the floor of the relay chamber is connected to a moveable contact element of the relay and has a downwardly applied plug element guided into a second of the plug receptacles shaft. Finally, at least one second current-conducting rail is provided with a respective, downwardly applied plug element guided in each of the two plug receptacles.

The inventive design of the relay assembly makes it possible to couple the control means for controlling the excitation voltage and the voltage source for the load circuit with a single multi-pole plug connector via the first plug receptacle shaft. The user means is separately coupled via its own multi-pole plug connector via the second plug receptacle shaft. Whereas the user means in traditional arrangements is externally connected in series with the load circuit voltage source between the two contact terminals of the relay, the two poles of the voltage source in the present invention are coupled via two plug connectors in the first plug receptacle shaft. Depending upon the type of cable plugs used, the plug receptacle shafts may be round or rectangular or can have some other arbitrary shape. Only one of the voltage source poles, however, is introduced directly into the relay and may possibly even be a one piece plug and contact element. The second pole, for example, the grounded pole, is conducted from the first plug shaft through the current-conducting rail to a plug in the second plug shaft. A further plug of the second plug shaft is then, in turn, connected via an internal current conducting rail to the second cooperating contact element of the relay. In this way, thus, the user means can be coupled to the switching circuit of the relay through two poles of a multi-pole plug.

The plug connections for the excitation winding are expediently conducted through the first plug shaft together with the terminals of the voltage source. However, it is also conceivable to provide respective separate plug shafts for the current feed and the winding terminals so that the coupling to a current source, on the one hand, and to the control means, on the other hand, can use respective separate cables. This is especially expedient when a plurality of relay systems are arranged in the relay chamber and are excited either simultaneously or independently of one another through a common control means.

It is also provided as a further development of the invention that additional bridge rails having plug elements arranged in both plug shafts be arranged in the relay chamber. For example, sensor signals which are supplied from the user means through the user cable are looped through the relay assembly to the control cable and, thus, to the control means without further measures. The sensor signals are not wired to the actual relay. For test purposes, for example, a further plug connection in the other plug shaft is provided for all current-conducting rails that have only one plug element in a plug shaft for the switching function. This is preferrably the first plug shaft which is connected to the control.

It is further provided in an advantageous development of the present device that the current-conducting rails have notches for accepting terminal wires of additional component parts such as diodes. The current conducting rails can also provide additional soldered supporting points in the relay chamber. The diodes, for example, are wired either in series or in parallel to the winding or may be connected in parallel to the user circuit as well. Other electronic and electro-mechanical components, such as additional relay systems, may also be accommodated within the relay chamber.

A number of specific developments of the assembly include the cooperating contact element and/or the current conducting rails being guided in channels in the header and/or clamped between the header and the coil member. The plug members are each flat plugs integrally applied to the current conducting rails or to the cooperating contact. The current conducting rail may be connected to a moveable contact element to form a respective plug element in each of two receptacle shafts. At least one additional bridge rail may be provided in the relay chamber, which connects only two plug elements arranged in two plug shafts. A ground terminal plug may be provided arranged in the first plug shaft connected through one current conducting rail to a plug element arranged in a second plug shaft. The current conducting rail of the contact to ground in the relay chamber is connected via a diode to a current conducting rail of the moveable contact element.

In another development, the moveable contact element is a leaf spring connected to the armature wherein the leaf spring carries a contact piece at its free end and is connected via a stranded conductor to the appertaining current conducting rail. The flat plugs which are conducted from the relay chamber through the plug shafts are each anchored in the header with either coined or cut catch noses or projections. At least one of the coil terminal elements forms a downwardly applied plug element in one embodiment that projects into the first plug shaft and has a soldered notch at its upper side for the end of the winding support wire embedded in the coil member flange. The solder support for at least one coil terminal and a connector element may be arranged at a distance therefrom and have a plug element projecting into the plug shaft which is anchored in the header, whereby the solder support and the connector element are bridged by a diode.

Yet further embodiments may include the current conducting rails having their principle planes residing perpendicularly relative to the chamber floor and having receptacle notches at their upper edge for lead wires of diodes and the like. The relay chamber has side walls applied to the header on all sides and may be closed with a cap that is inverted thereover. The cap is lockable to the header and includes inwardly projecting ribs which press against projections of the coil member that lie opposite one another. A further development provides the header with applied receptacle pockets for a retaining clip on at least one side.

DESCRIPTION OF THE PREFERRED EMBODIMENTS

Figure 1:
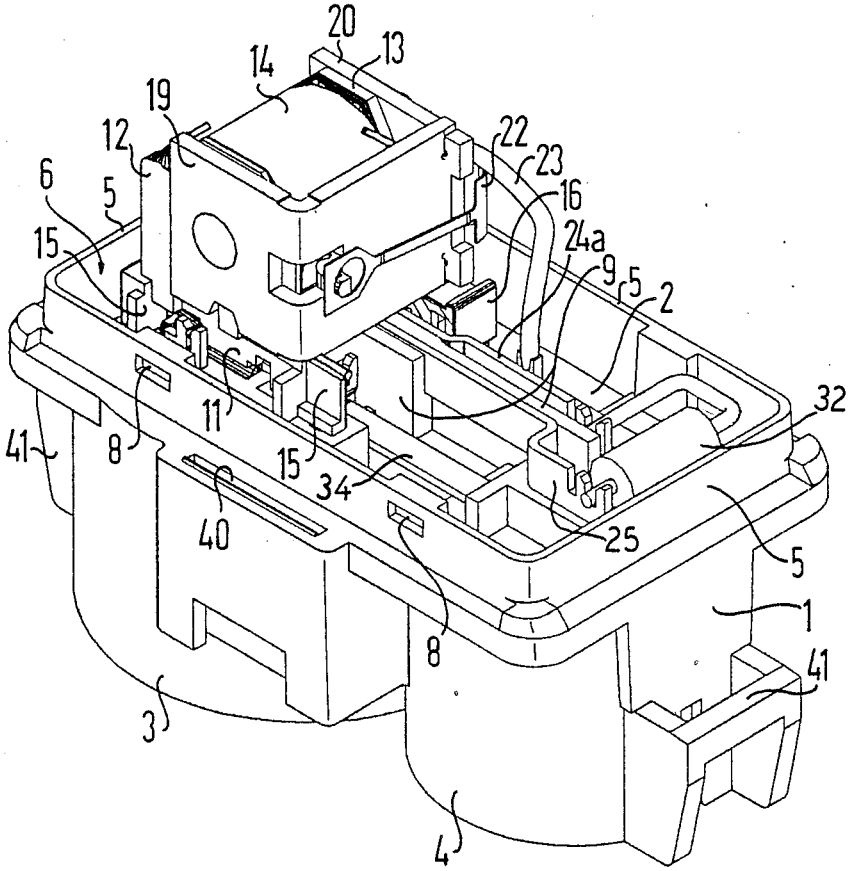
FIG. 1 is a perspective view of a relay assembly of the present invention shown without a cap.
Figure 2:
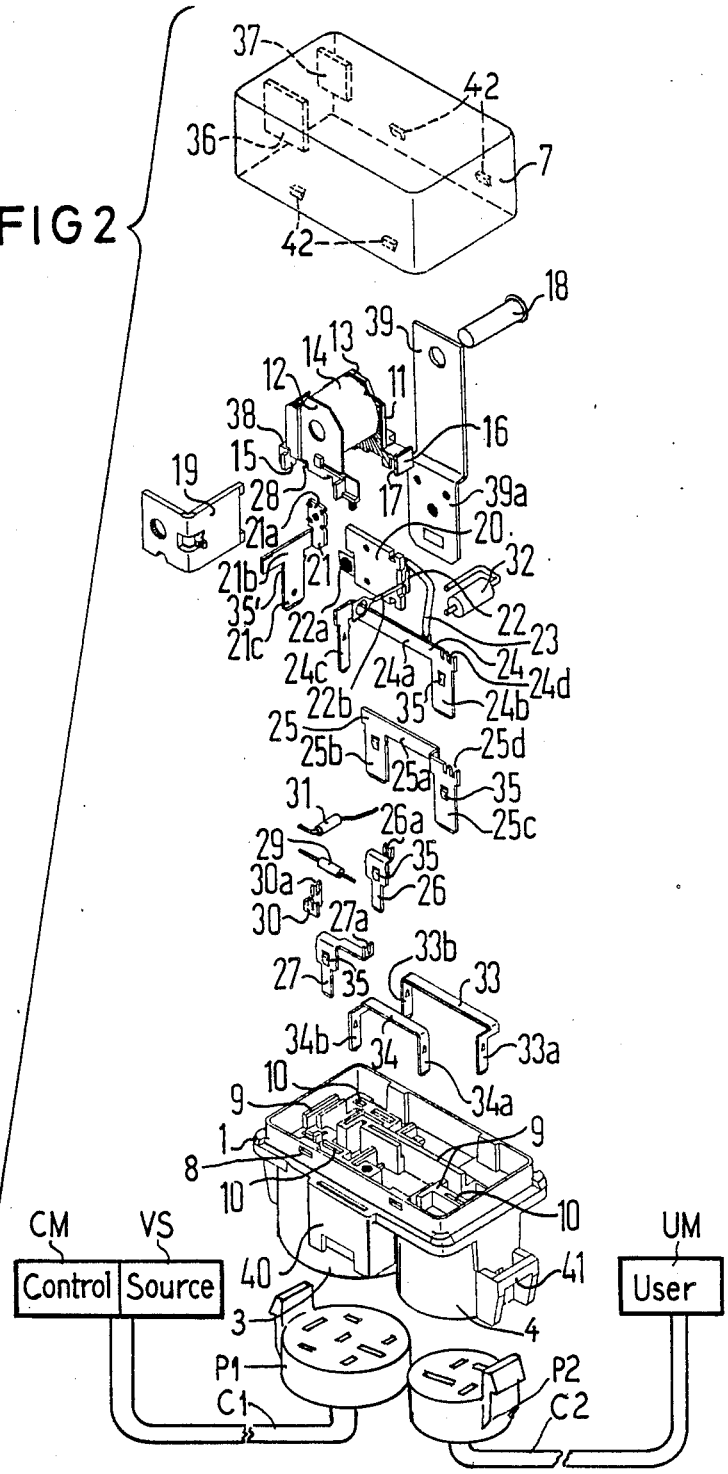
FIG. 2 is an exploded view showing individual parts of the relay assembly of FIG. 1.
Figure 3:
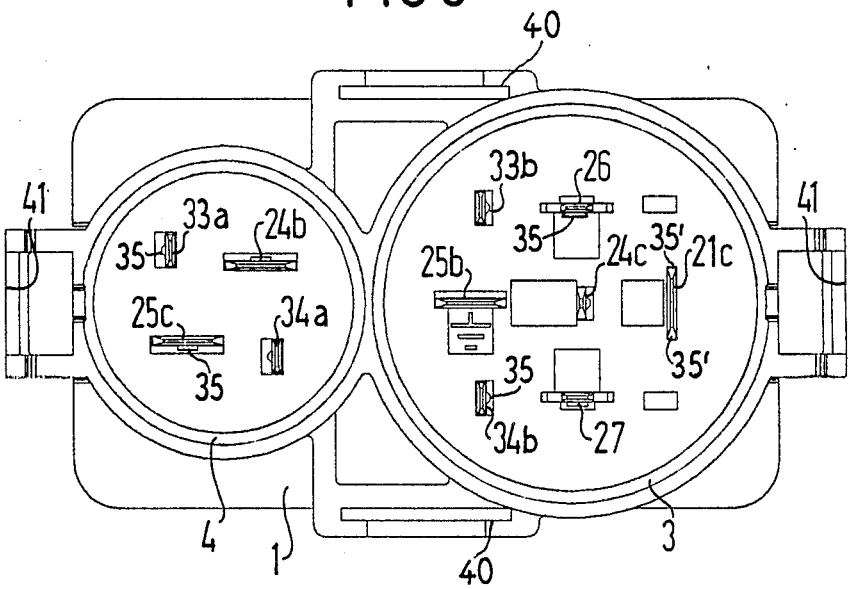
FIG. 3 is a bottom plan view of the relay assembly from the underside.

A relay assembly according to the principles of the present invention is shown in FIGS. 1 through 3 which includes, as its base member, a header 1 having an essentially flat floor part 2 from which two plug shafts or receptacles 3 and 4 extend in a downward direction. In the illustrated example, the plug receptacles are cylindrically shaped openings for receiving cylindrical plugs P1 and P2. Flat plug elements or prongs, which are set forth in greater detail hereinafter, project into the plug receptacles 3 and 4 from the upper side, the flat plug elements being guided through openings in the floor part 2. The plug elements are connected to a cable C1 or C2 and, thus, to a remote assembly, such as to a control means or a user means UM, by plugging cable plug connectors or plug couplings P1 and P2 into the plug receptacles 3 and 4. In the present example, the plug receptacle 3 is designed for the seven-pole plug connector P1 and the plug receptacle 4 is designed for a four-pole plug connector P2.

Toward the upper side of the header 1, the rectangular floor part 2 is provided with side walls 5 extending along all sides to initially form an upwardly open relay chamber 6. The relay chamber 6 is closed by an inverted cap 7 (shown in FIG. 2) which has catch noses or projections 42 (shown in dotted outline) that engage into recesses 8 in the side walls 5. Within the relay chamber 6, the floor part 2 has a number of ribs 9 which serve as guides to form channels for parts lying therebetween for holding a magnet system as well as for holding current conducting rails and additional component parts. The relay chamber 6 also has openings or passages 10 (shown in FIG. 2) in the floor 2 between the ribs 9 into which the plug elements are conducted downwardly into the plug receptacles 3 and 4. The plug elements are preferably flat plugs.

A relay system is arranged in the relay chamber 6, the relay system having a coil member 11 as a carrier that includes two flanges 12 and 13 between which is applied a winding 14. Downwardly extending continuations 15 and 16 of the flanges 12 and 13 enable the coil member 11 to rest on the ribs 9 on the header floor 2. The continuations 15 and 16 include recesses 17 (shown in FIG. 2) which mutually engage with correspondingly shaped portions of the ribs 9 to hold the coil member 11 on the header 1. The magnet system also includes a core 18, an angled yoke 19, and a flat armature 20 which, like the yoke 19, has its principle plane lying perpendicular to the floor 2. The magnet system is, thus, constructed in a traditional way and so does not require a more detailed description thereof.

A contact pocket (which is behind the relay in FIG. 1) for accepting a stationary cooperating contact element 21 as shown in FIG. 2 is applied to the coil member flange 13. A possible embodiment of this pocket is shown, for example, in German published application No. 34 28 595. In FIG. 2 can be seen the stationary cooperating contact element 21 having an upwardly extending contact leg 21*a* that extends into the contact pocket. The contact element 21 also comprises a fastening part 21*b* which is clamped between the ribs 9 of the header 1 on the one side and the coil member 11 on the other side and is thereby fixed. The contact element 21 further comprises a downwardly applied flat plug element 21*c* that extends into the plug receptacle 3 through a corresponding opening 10 in the header floor 2. The plug element 21c can be seen in FIG. 3.

As can be seen in FIG. 2, a contact spring 22 rests against the armature 20 at the outside of the armature and is welded or riveted thereto to serve as a movable contact element. The contact spring 22 includes a contact leg 22a that interacts with the contact leg 21a of the cooperating contact element 21, the contact leg 22a being the free end of the contact spring 22. A further leg 22b of the contact spring 22 serves, in a known way, to provide a restoring force to the armature 20.

A stranded conductor 23 is provided as a power lead to the contact spring 22. The stranded conductor 23 is welded, first, to a contact rivet in the contact spring leg 22a and, second, to a current conducting rail 24. The current conducting rail 24 has a central part 24a secured between the ribs 9 of the header 1 and also includes a downwardly extending flat plug element 24b extending into the plug receptacle 4. A second flat plug element 24c extends from the other end of the current conducting rail 24 into the plug receptacle 3 and serves for testing purposes.

A further current conducting rail 25 is anchored between the ribs 9 of the header 1 in a similar fashion and likewise includes a center part 25a which, like the center part 24a of the first current conducting rail 24, has its principle plane lying perpendicular to the plane of the floor 2. The second current conducting rail 25 is arranged between the ribs 9 and has two downwardly extending flat plug elements 25b and 25c that extend into the respective plug receptacles 3 and 4.

Further flat plug elements 26 and 27 are anchored in the header 1 to provide electrical connections to the terminals of the winding 14. The further flat plug elements 26 and 27 comprise respective notches 26a and 27a at their upper sides for accepting and for clamping and/or soldering lead wires. If desired, winding support wires 28 which are anchored in the coil flanges 12 and 13 may be directly connected to the appertaining flat plug elements via notches 26a and 27a.

When, for example, a diode, such as a diode 29, is connected in series with the winding 14, one end of the winding 14 is electrically connected to a supporting point or part 30 anchored in the header 1, whereas the diode 29 is then soldered in between a notch 30a in the supporting part 30 and the notch 27a. A parallel connected diode 31 may also be soldered in between the notches 26a and 27a. Moreover, additional component parts may be accommodated within the relay chamber 6 and may be connected to the various terminals. For example, a parallel diode 32 is shown in the drawings connected between the two current conducting rails 24 and 25. The parallel diode 32 is clamped or soldered in corresponding notches 24d and 25d of the current conducting rails 24 and 25.

The illustrated example, moreover, includes additional bridge rails 33 and 34 arranged along the floor 2 of the relay chamber 6. The additional bridge rails 33 and 34 each have a flat plug element 33a or 33b and 34a or 34b extending into each of the two plug receptacles 3 and 4. For example, sensor signals in the load circuit can be through connected with these current conducting bridges for control via the existing multiple cable. The flat plug elements, such as the plug elements 25c, 26 and 27, are each provided with coined or cut catch noses or projections extending laterally therefrom 35 and are anchored in the header 1 in this way so that they may withstand greater plugging forces. The plug element 21c has projections 35' extending from the edges thereof for anchoring it in the header 1.

During assembly of the present relay device, the discrete parts, which are shown in FIG. 2, are successively anchored in the header 1 and are secured and may also be soldered as well. The cap 7 is inverted thereover in order to close the relay chamber 6 to the outside. The cap 7 has ribs 36 and 37 extending from the inside thereof. The ribs 36 and 37 press onto corresponding projections 38 of the coil member 11 and, thus, also fix the magnet system in place. By introducing a casting compound between the side walls 5 and the cap 7, the relay chamber 6 may be tightly sealed closed. Insofar as the through openings 10 require additional sealing, the floor 2 of the relay chamber 6 or the floor of the plug receptacles 3 and 4 may be cast with a casting compound either previously or in the same work sequence as the introduction of the casting compound described above.

A retaining clip 39 which as a crimped lower part 39a engaged in a receptacle pocket 40 is applied to the header 1 to serve for external fastening of the assembly in place. One such receptacle pocket 40 is expediently provided at each of the two long sides of the header 1 so that the assembly may be optionally secured in two different positions. The retaining clip 39 is outside of the cap 7.

Referring to FIG. 3, the interior of the two plug receptacles 3 and 4 are shown in a view from below. The function of the individual plug elements of the specific exemplary embodiment which has been illustrated shall be set forth with reference to this bottom plan view. The connection of the relay assembly to a control means CM and to a voltage source VS is produced via the plug receptacle 3 with the assistance of a seven-pole plug connector P1. The excitation voltage is applied through the two flat plug elements 26 and 27 while the load voltage is applied to the plug element 21c. The grounded pole is applied to the plug element 25b and is looped through therefrom to the plug element 25c by the rail 25. The user means UM which may, for example, be a motor, is connected between the plug elements 25c and 24b through a four pole plug P2 insertable into the plug receptacle 4. The plug element 24b thereby connects the second pole of the user means UM to the contact spring 22 through the rail 24 so that the user means UM is closed in this way when the relay attracts. Sensor signals from the user means UM are received via the plug elements 33a and 34a and are connected through to the control means CM via the plug elements 33b and 34b. Additional retaining webs 41 to which corresponding catch elements on the plugs P1 and P2 are engaged are applied to the header 1 for fastening the multiple plug connectors P1 and P2 into the plug receptacles 3 and 4.

Thus, there has been shown and described a relay assembly which can be quickly and easily connected and disconnected from a control means and a user means by multi-pole connectors fastenable in a header.

Although other modifications and changes may be suggested by those skilled in the art, it is the intention of the inventor to embody within the patent warranted hereon all changes and modifications as reasonably and properly come within the scope of his contribution to the art.

I claim:

1. An improved relay assembly, said relay assembly having a coil member including a winding, a core, a yoke and an armature coupled to at least one movable contact element, at least one stationary contact element for cooperating contact with said at least one movable contact element, the improvement comprising:

a header having a flat floor part with an upper side and an underside;

side walls extending on all side from said header toward said upper side of said floor part to form a relay chamber;

said header forming at least two plug shafts for accepting one multipole plug connector each;

at least one stationary contact element having a downwardly applied plug element guided into a first of said plug shafts;

at least one first current-conducting rail arranged on a floor of said relay chamber;

a movable contact element connected to said first conducting rail and having a downwardly applied plug element guided into a second of said plug shafts; and at least one second current conducting rail having a downwardly applied plug element guided into each of said two plug shafts.

2. An improved relay assembly as claimed in claim 1, wherein said stationary contact element is guided in channels in said header.

3. An improved relay assembly as claimed in claim 1, wherein said current conducting rails are guided in channels in said header.

4. An improved relay assembly as claimed in claim 1, wherein said at least one stationary contact element is clamped between said header and said coil member.

5. An improved relay assembly as claimed in claim 1, wherein said current conducting rails are clamped between said header and said coil member.

6. An improved relay assembly as claimed in claim 1, further comprising:

plug elements for said stationary contact element and for said movable contact and for terminals connected to said winding, said plug elements being conducted to said underside of said header through guide channels proceeding through said header, each of said plug elements being flat plug elements integrally applied to one of said current conducting rails and said stationary contact element.

7. An improved relay assembly as claimed in claim 1, wherein said at least one first current conducting rail connected to said movable contact element forms a plug element extending into each of said two plug shafts.

8. An improved relay assembly as claimed in claim 1, further comprising:

at least one additional bridge rail in said relay chamber, said bridge rail connecting only two plug elements arranged in said two plug shafts.

9. An improved relay assembly as claimed in claim 1, further comprising:

a ground terminal plug element arranged in said first plug shaft;

one of said current conducting rails connecting said ground terminal plug element to a plug element in said second plug shaft;

a diode connecting said one of said current conducting rails to said first current conducting rail.

10. An improved relay assembly as claimed in claim 1, wherein said movable contact element is a leaf spring connected to said armature, a contact piece on a free end of said leaf spring, and a stranded conductor connecting said leaf spring to said first current conducting rail.

11. An improved relay assembly as claimed in claim 6, further comprising: catch projections on each of said flat plug elements to anchor said plug elements into said plug shafts in said header.

12. An improved relay assembly as claimed in claim 1, further comprising:

coil terminal elements being plug elements conducted through said floor part of said header, at least one of said coil terminal elements forming a downwardly directed plug element that projects into said first plug shaft, said downwardly directed plug element having a soldered notch at an upper side;

a winding support wire embedded in one of said two coil member flanges and supported at an end by said soldered notch.

* * * * *